United States Patent [19]

Taddeo

[11] Patent Number: 4,837,837

[45] Date of Patent: Jun. 6, 1989

[54] LOUDSPEAKER

[76] Inventor: Anthony R. Taddeo, 800 Corwin Rd., Rochester, N.Y. 14610

[21] Appl. No.: 117,040

[22] Filed: Nov. 5, 1987

[51] Int. Cl.[4] ..... H04R 1/28; G10K 13/00

[52] U.S. Cl. ..... 381/158; 381/159; 181/151; 181/146

[58] Field of Search ..... 381/158, 159, 153; 181/146, 151, 155

[56] References Cited

U.S. PATENT DOCUMENTS

| | | | |
|---|---|---|---|
| 2,031,500 | 2/1936 | Olney | 181/151 |
| 2,765,864 | 10/1956 | Glenn | 181/151 X |
| 2,926,740 | 3/1960 | Holland | 181/151 |
| 3,729,061 | 4/1973 | Tamura | 181/146 |
| 3,875,706 | 4/1975 | Okawa | 181/289 X |
| 4,044,855 | 8/1977 | Kobayashi | 181/151 |

FOREIGN PATENT DOCUMENTS

| | | | |
|---|---|---|---|
| 3214226 | 10/1983 | Fed. Rep. of Germany | 381/154 |
| 0496487 | 11/1938 | United Kingdom | 181/151 |

OTHER PUBLICATIONS

Cook, "Handbook of Textile Fibres", 1960, pp. 113–115.

Bradbury, "The Use of Fibrous Materials in Loudspeaker Enclosures", Audio Engineering Society, Apr. 1976, pp. 404–412.

Speakman et al., "A Contribution to the Theory of Milling", Journal of the Textile Institute, vol. 22, pp. T339–T348, 1931.

Bergen, "Wool Handbook", pp. 197–199.

Kaswell, "Textile Fibers, Yarns, and Fabrics", 1953, pp. 67–82.

*Primary Examiner*—Eugene R. LaRoche

*Assistant Examiner*—Seung Ham

*Attorney, Agent, or Firm*—Shlesinger, Fitzsimmons & Shlesinger

[57] ABSTRACT

The efficiency of a loudspeaker housing is substantially increased by incorporating in the housing, in the form of a lining or stuffing, a quantity of goat's hair, preferably mohair.

1 Claim, 1 Drawing Sheet

LOUDSPEAKER

BACKGROUND OF THE INVENTION

Figure 1:
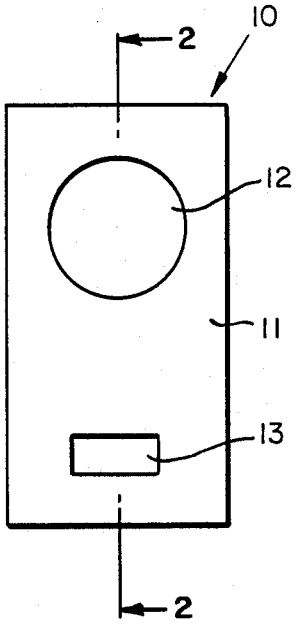

This invention relates to loudspeakers, and more particularly to a loudspeaker having improved damping means for removing unwanted higher frequency sounds. Even more particularly, this invention relates to an improved loudspeaker containing a fibrous damping material which considerably reduces undesirable Q losses as compared to damping materials heretofore employed.

Conventional loudspeaker housings include the closed and vented varieties. The closed type of housing has no separate opening therein apart from the opening in which the speaker or driver is mounted. Vented housings have, in addition to the opening which houses the speaker, one or more openings which communciate with the exterior of the housing. Usually this type of housing or enclosure has an open tunnel or port which allows the passage of air in and out of the housing. Still another type of housing may include passive radiators in one or more openings in addition to the opening in which the speaker is mounted.

Still another form of speaker housing is known as the transmission line type, and comprises a housing containing a long pipe or labyrinth open at one end on the exterior of the housing, and communicating at its opposite end with the speaker or driver. The length of the labyrinth typically is made about 25% of the of the resonant wave length of the driver or speaker; and the pipe is folded or baffled back and forth intermediate its ends in a labyrinth manner so that the overall configuration of the housing will result in a practical shape.

As a general rule all such speaker housings or cabinets are designed to manipulate the resonant peak sound waves inherent in the moving coils of the associated loudspeakers or drivers.

In the past it has been conventional to employ in housings of the type noted above some form of damping or stuffing material for the damping of undesired sound waves. In some instances the damping material is simply in the form of a lining inside the housing; and in other cases the damping material is stuffed in the housing completely to block off certain portions thereof, such as for example portions of the labyrinth formed in a transmission line housing. Typical materials used in past have been wool, fiberglass and polyester fibers. Foam materials have also been used.

The primary reasons for utilzing damping materials in such housings are twofold. First, the damping material is used to absorb unwanted higher frequency sounds, such as internal reflections and standing wave resonances between walls of the cabinet, and to the extent that the lower frequencies are attenuated to a much lower degree, the damping material therefore acts as a desirable low-pass filter. Secondly, the damping materials are used to reduce the necessary cabinet volume. In transmission line or labyrinth type enclosures, the damping material also acts to reduce the speed of sound, thereby reducing the necessary line length and enclosure dimension. In enclosed housings, or vented housings (including housings of the type containing passive radiators), the isothermal characteristics of the damping materials are used effectively to increase the box compliance or size.

Damping materials, however, also have certain limitations. For example, the use of such materials causes absorptive losses, which normally tend to increase in correspondence with the increase in the quantity of damping material employed. In the vented form of enclosure these losses decrease the enclosure "Q", which for purposes of this application will be understood to describe resonant magnification in speaker housings. (See *The Loud Speaker Design Cookbook* by Vance Dickason, Third Ed.) As a consequence, the presence of the damping material contributes to a reduction in the efficiency of the speaker housing or box. For this reason most vented enclosures use a minimal amount of damping material, such as for example simply by coating the inner walls of the enclosure with the damping material.

A primary purpose of this invention, therefore, is to improve the efficiency of a speaker housing by increasing the quantity of damping material in the housing without significantly increasing its absortive losses.

A more specific object of this invention is to provide for speaker housings of the type described a damping material which can be used in large quantities without causing excessive absorptive losses, thereby permitting the use of smaller and more efficient housings.

Other objects of the invention will be apparent hereinafter from the specification and the recital of the appended claims, particularly when read in conjunction with the accompanying drawing.

SUMMARY OF THE INVENTION

The overall efficiency of a speaker housing, such as for example the tranmission line variety, has been increased, as compared to such housing which heretofore employed wool as a damping material, by using goat's hair (e.g. Mohair) instead of wool for the damping material. Typically the goat's hair is stuffed in rather large quantities, as compared to the wool heretofore employed, in a portion of the speaker labyrinth to interpose the goat's hair stuffing between the speaker or driver and the outlet end of the labyrinth.

THE DRAWING

Figure 2:
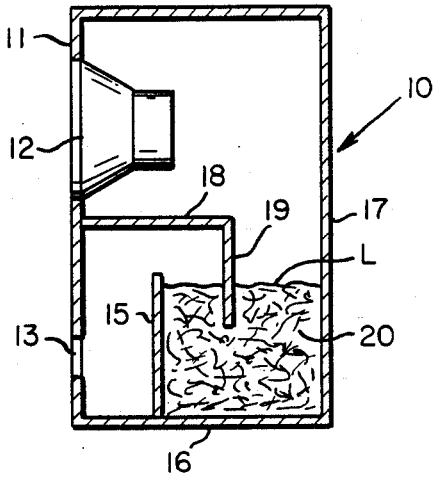

FIG. 1 is a front elevational view of one type of loudspeaker cabinet or housing which may be employed in this invention; and FIG. 2 is a sectional view thereof taken generally along the line 2—2 in FIG. 1 looking in the direction of the arrows.

PREFERRED EMBODIMENT OF THE INVENTION

For the purpose of reducing absortive losses caused by the use of a damping material in speaker housings of the type described, an effort was made to isolate the cause of such losses. For example, although the prior art has suggested that in most cases wool fiber is preferred to synthetic fiber as a damping material, no explanation for such preferance has been given. Applicant therefore conducted a series of tests which confirmed that, as between wool and polyester fibers of approximately the same diameter, and therefore of approximately the same drag coefficient, wool fibers, when used as a damping material, produced lower absortive losses for given amounts (by weight) of material than did the polyester fibers. In seeking some reason for this distinction it was discovered that natural wool fibers, despite having a rough, scaly appearance, (the presence of scales extending from the root to the tip ends of a fiber) nevertheless exhibited less friction than synthetic fibers. (See *Wool Handbook*, Vol. 1, by Werner Von Bergon, pp. 197–199.) A review of literature indicated that goat hair fibers, such as mohair, although somewhat similar to wool fibers, nevertheless exhibited even less scaliness than wool fibers. (See *Handbook of Textile Fibers* by J. Gordon Cook, pp. 132–135.) Tests were therefore conducted to compare the effect on the quality of sound produced by a speaker enclosure when damped with a goat hair material, such as mohair, as compared to that of an enclosure utilizing wool as a damping material. Surprisingly, test results indicated that goat hair fibers, despite exhibiting less scaliness than wool fibers, produced a substantial improvement in the overall efficiency of the operation of a speaker enclosure, as compared to one utilizing wool fibers as a damping material.

In one such experiment a vented enclosure was constructed. The impedance at the port tuning frequency was measured, and a target impedance of 7.2 ohms, which would represent a "Q" loss of about 7, was selected. For each test a single damping material (either wool fibers, polyester fibers or mohair fibers) was added in increasing amounts until the port impedance reached 7.2 ohms. The fibers were all of the same approximate diameter. It was discoverd that it took approximately four ounces of polyester fiber, seven ounces of wool, or fourteen ounces of mohair to produce this result. As a consequence, for a given amount of absorptive loss at critical lower frequencies, it is obvious that one may use a greater weight or amount of goat hair (for example mohair), as compared to known damping materials, and thus can achieve the advantage of superior high frequency damping, as well as isothermal, box size efficiency.

One such manner in which mohair fibers can be employed in accordance with this invention is shown in the drawing, wherein 10 denotes generally a speaker housing of conventional configuration having mounted in the usual manner in an opening in its front wall 11 a conventional speaker or driver 12. The front wall 11 also has therein below the speaker 12 a port or opening 13.

Mounted within housing 10 are two partitions, one of which comprises a plane, vertically disposed wall 15, which projects part way upwardly from the housing bottom wall 16 between and parallel to the front and rear walls 11 and 17, respectively, of the housing. The other partition is right angular in configuration, and consists of a first, plane leg 18 which projects horizontally rearwardly from the front housing wall 11 to overlie the upper end of partition 15, and a second, plane leg 19, which projects vertically downwardly from leg 18 into the space between partition 15 and the rear housing wall 17.

In order to dampen undesirable sound waves in housing 10, the labyrinth, which is formed in the housing by the partitions 15, 18, 19 between the driver 12 and the port 13, is partially stuffed or filled as at 20 in FIG. 2 with mohair fibers up to the level L. Thus, sound waves emanating from the speaker 12 must pass through the mohair filling 20 before reaching port 13.

From the foregoing it will be apparent that the present invention has discovered that, although it heretofore has been suggested that wool fibers would be preferable over polyester or fiberglass fibers as damping material for loudspeaker housings and the like, substantially improved results can be achieved by utilzing goat's hair (for example mohair) rather than wool. It is believed that the use of mohair results in the production of even lower frictional losses, when used as damping materials in loudspeaker enclosures of the type described, as compared to natural fibers such as wool.

Although the drawing has illustrated the use of goat's hair damping material in connection with only one type of cabinet or housing, it is to be understood that the efficiency of other types of housings (e.g. closed box, acoustic suspension systems, simple ported or passive, radiator enclosures) also can be significantly improved by using goat's hair as a damping material.

While this invention has been described in connection with only certain embodiments thereof, it will be apparent that it is capable of further modifications, and that this application is intended to cover any such modifications as may fall within the scope of one skilled in the art or the appended claims.

What is claimed is:

1. In combination with a loudspeaker housing having therein a pair of openings, a loudspeaker mounted in and closing one of said openings, and a plurality of baffles mounted in said housing and forming therein a labyrinth communicating at one end with said loudspeaker and at its opposite end with the other of said openings in said housing, an improved high frequency sound damping material comprising a quantity of mohair fibers positioned in said housing and operatively filling a portion of said labyrinth to a level such that all sound waves emanating from said loudspeaker must pass through said mohair fibers before reaching said other opening, said mohair fibers having a scaliness less than that of wool fibers.

* * * * *